United States Patent [19]

Benedict

[11] Patent Number: 4,941,775

[45] Date of Patent: Jul. 17, 1990

[54] CATHODIC PROTECTION OF CRITICAL OFFSHORE MARINE STRUCTURE CRITICAL COMPONENTS BY MAKING THE CRITICAL COMPONENT NOBLE (PASSIVE) TO THE BALANCE OF THE PLATFORM

[76] Inventor: Risque L. Benedict, 1528 Tioga Trail, Fallbrook, Calif. 92028

[21] Appl. No.: 161,159

[22] Filed: Feb. 26, 1988

[51] Int. Cl.[5] ..... E02B 17/00; E02D 5/60; E02D 9/00; C23F 11/00

[52] U.S. Cl. ..... 405/216; 204/147; 204/196; 405/195; 422/6; 422/7; 422/14

[58] Field of Search ..... 204/147, 148, 196, 197; 405/211, 216, 195; 422/6, 7, 14

[56] References Cited

U.S. PATENT DOCUMENTS

| | | | |
|---|---|---|---|
| 2,454,956 | 11/1948 | Young | 204/197 |
| 2,752,308 | 6/1956 | Andrus | 204/196 |
| 2,866,742 | 12/1958 | Sutton | 204/197 |
| 3,047,478 | 7/1962 | Marsh et al. | 204/148 |
| 3,629,092 | 12/1971 | George | 204/197 |
| 3,707,450 | 12/1972 | Townsend | 204/147 |
| 3,719,049 | 3/1973 | Shaw et al. | 405/216 |
| 3,992,272 | 11/1976 | Maxson et al. | 204/147 |
| 4,192,697 | 3/1980 | Parker et al. | 156/188 |
| 4,211,503 | 7/1980 | Peterson et al. | 405/216 |
| 4,213,486 | 7/1980 | Samour et al. | 138/143 |
| 4,367,300 | 1/1983 | Aoki et al. | 524/2 |
| 4,439,293 | 3/1984 | Vaughan | 204/182.4 |
| 4,576,730 | 3/1986 | Perkins | 252/174.14 |
| 4,614,461 | 9/1986 | Taniguchi et al. | 405/211 |
| 4,619,557 | 10/1986 | Salama et al. | 405/211 |
| 4,830,540 | 5/1989 | Abrams | 405/216 |

OTHER PUBLICATIONS

"Cathodic Protection of Offshore Structures", by Potosnak et al., *Corrosion Prevention and Control,* Mar.-/Apr. 1968, p. 12.

"The Corrosion of Metals with Special Reference to Protective Metallic Coatings", U. R. Evans, *The Metal Industry,* Dec. 21, 1928, p. 589.

"Galvanic Corrosion of Dissimilar Metals", *Chemical and Metallurgical Engineering,* Jun. 1943, p. 66.

"The Electrochemistry of Corrosion", by C. L. Bulow, *Metal Finishing,* Oct. 1943, p. 631.

"Cathodic Protection of Fourteen Offshore Drilling Platforms", by E. P. and G. L. Doremus, *Corrosion,* Jul. 1950, pp. 216–224.

*Primary Examiner*—Randolph A. Reese
*Assistant Examiner*—John A. Ricci
*Attorney, Agent, or Firm*—Charles H. Schwartz; Ellsworth R. Roston

[57] ABSTRACT

A corrosion protection system for protecting critical parts of an offshore structure. The structure is composed of an assembly of critical parts representing a small portion of the structure and noncritical parts representing a large portion of the structure. The critical parts are coated with a layer of material to form a protective treatment so that the critical parts are made electrochemically noble or passive relative to the uncoated noncritical parts when the offshore structure is submerged. The noncritical parts are electrochemically active relative to the coated critical parts to provide for cathodic protection current supplied to the coated critical parts by the uncoated active parts to produce corrosion protection to the coated critical parts. An accelerated corrosion system for destroying the critical parts uses a conductive layer including a slit and with the slit initially protected and then removed to accelerate corrosion to destroy the offshore structure.

85 Claims, 6 Drawing Sheets

FIG. 1 PRIOR ART
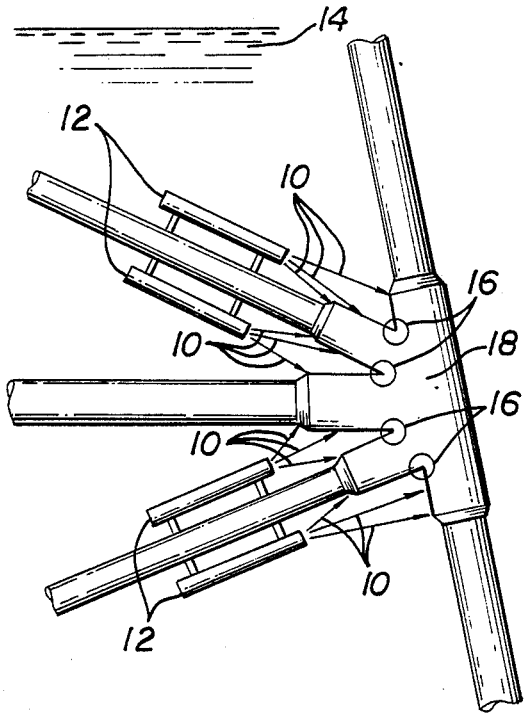
FIG. 2
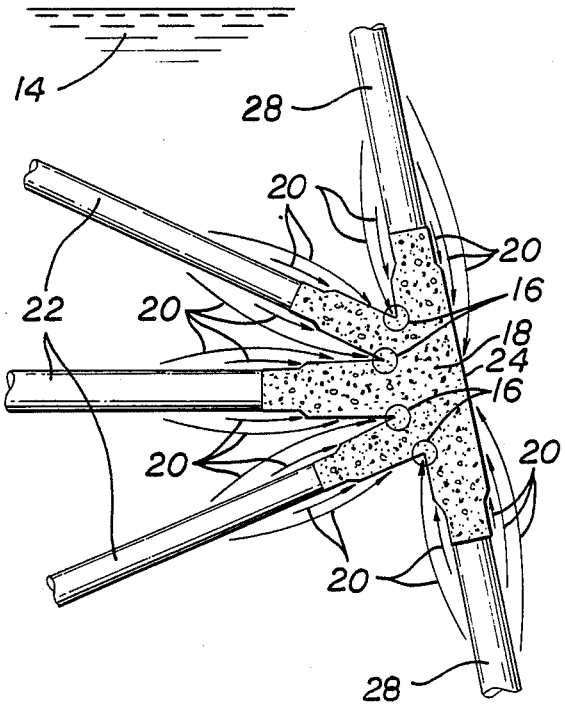
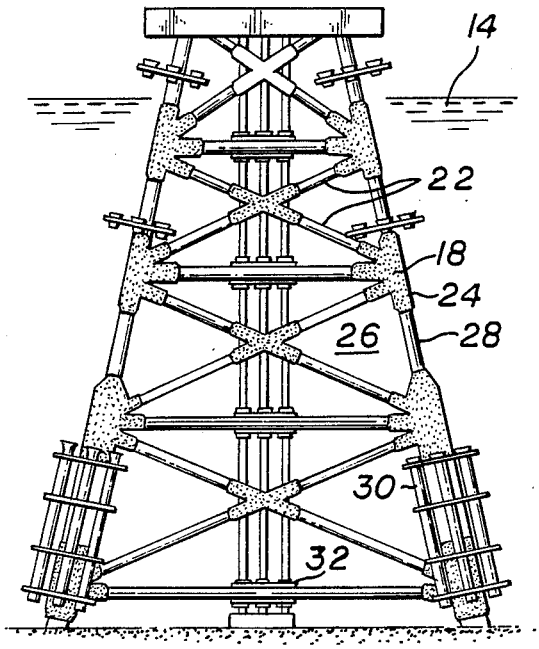
FIG. 3
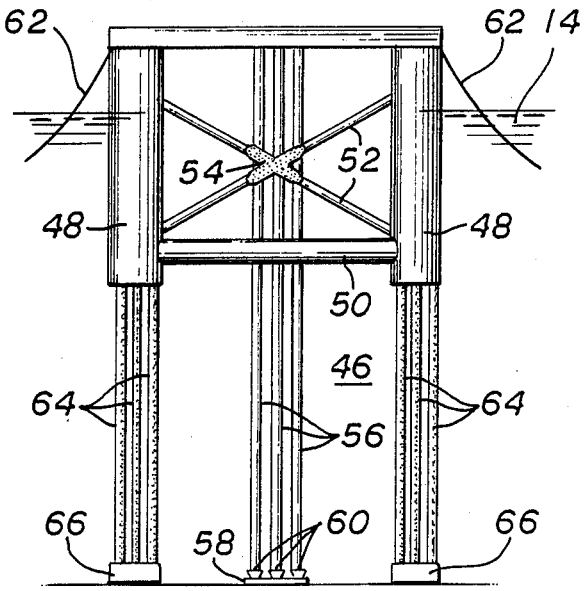
FIG. 4

FIG. 3(a)
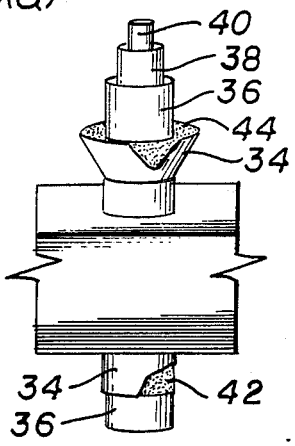
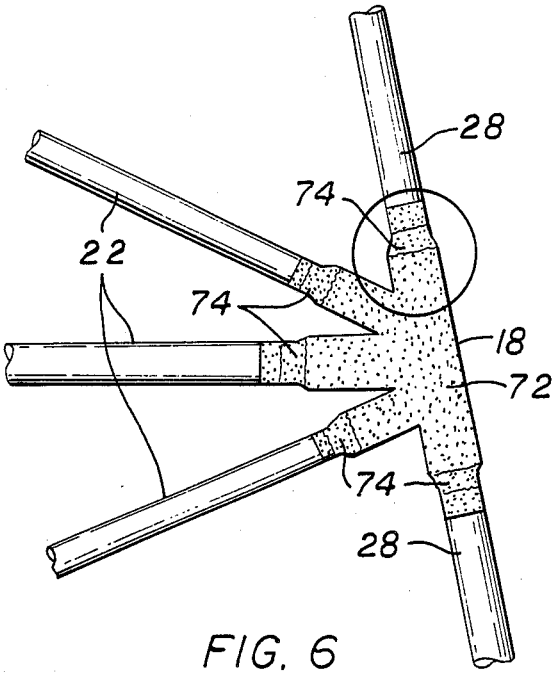
FIG. 6
FIG. 5
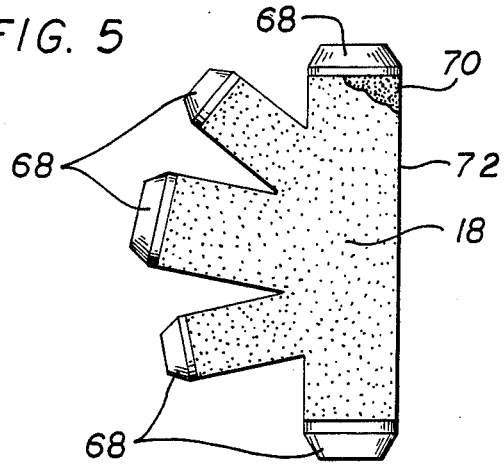
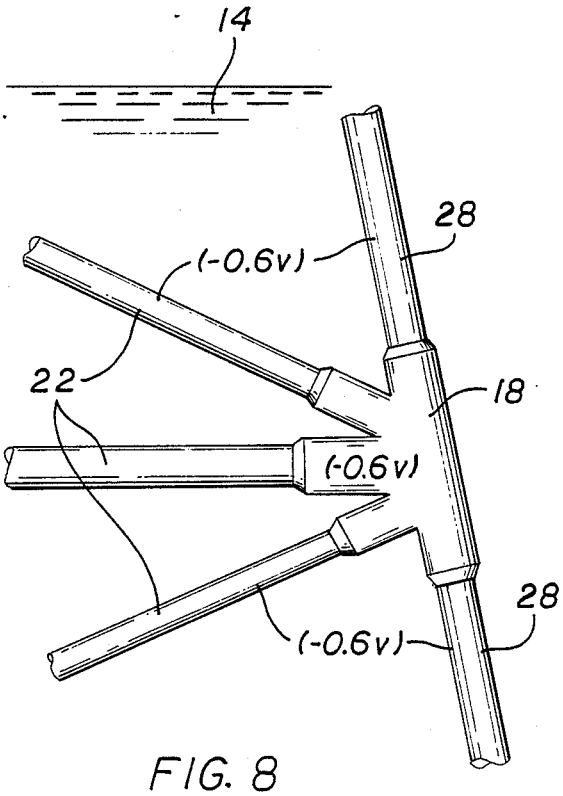
FIG. 8
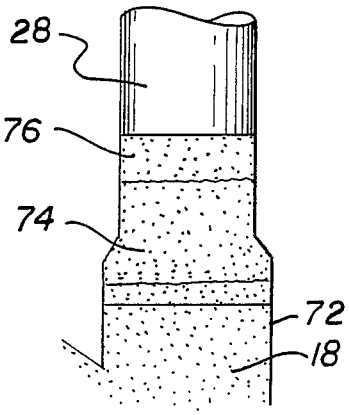
FIG. 7

CATHODIC PROTECTION OF CRITICAL OFFSHORE MARINE STRUCTURE CRITICAL COMPONENTS BY MAKING THE CRITICAL COMPONENT NOBLE (PASSIVE) TO THE BALANCE OF THE PLATFORM

BACKGROUND OF THE INVENTION

1. Field of the Invention

The present invention relates to the corrosion protection of the critical parts of offshore marine steel structures. Specifically, in the present invention the critical parts such as the nodes are made electrochemically noble or passive. The noncritical parts of the offshore steel structure remain active. Because the active and passive areas of the structure are both electronically and electrolytically coupled, cathodic protection of the critical parts occurs.

2. Description of the Prior Art

In the prior art, corrosion protection of the critical components of offshore platforms, such as nodes, is generally accomplished by cathodic protection of the entire underwater jacket area. This protection is usually with sacrificial anodes such as aluminum, but occasionally impressed current systems are used. In either event current is supplied from the cathodic protection anodes to the entire underwater steel jacket area of which the nodes are an integral part. Since the critical platform parts, such as the nodes, normally constitute only approximately 15% of the underwater jacket area, the existing cathodic protection designs waste about 85% of the cathodic protection current capacity on noncritical jacket members such as platform legs or tubular braces.

It is generally accepted that the structurally critical areas, such as the nodes, cannot tolerate the initiation of corrosion pitting since such pits act as stress raisers. Stress raisers can initiate stress corrosion cracking (SCC), corrosion fatigue or, with cyclical action, mechanical fatigue. Any of these mechanisms can result in catastrophic failure of the critical component. Platform structural damage or even collapse could result. It is also generally accepted that a great amount of corrosion is acceptable on the noncritical steel members of the platform jacket such as the legs and tubular bracing. The prime purpose of conventional aluminum anodes on offshore jackets is to "throw" cathodic protection current into the "hidden" recesses of a critical platform component, such as the node.

Since welding is not acceptable on heat treated nodes, the usual design for aluminum anodes involves a clustering of anodes as close as possible to the "hidden" recesses of the node by welding the anodes on the tubular braces adjacent to the node. This may entail the installation of 50, 100 or even 200% more aluminum anodes than would be required if rapid corrosion protection of the structure were not required. The geometry of some complex nodes makes it impossible to achieve either instantaneous or even adequate cathodic protection over a period of time. Another example of a difficult to protect area is a surface casing within a guide cone. When a large number of wells are drilled in a cluster, it is impossible to provide adequate cathodic protection to the surface casings in the center of the well bay.

The above are examples of circumstances under which the existing cathodic protection systems cannot provide adequate corrosion control to either the platform or the well casing. It must be understood that economic stakes are enormous. Some of the largest deep water platform jackets cost over $100 million. Some completed production platforms with wells cost over $1 billion. The ultimate value of the reservoir produced per billion dollar platform would likely exceed $10 billion. It is, therefore, imperative from an economic, environmental, governmental mandate or insurance requirement that the most effective corrosion control program possible be utilized. In addition to the above, the following are specific problems faced with prior art cathodic protection systems.

High strength steels are more susceptible to hydrogen embrittlement than are the mild steels more commonly used in offshore marine platform jacket construction. Hydrogen embrittlement can result in catastrophic failure of high strength steel. The more advanced design concepts for deep water, such as the Tensioned Leg Platform (TLP) or Guyed Tower, employ large quantities of high strength steel. Cathodic protection, even using aluminum anodes, can produce potentials sufficiently electronegative (e.g., more negative than −1.1 volt to a copper sulfate electrode) to initiate hydrogen embrittlement. The prior art systems, therefore, pose a potential problem to high strength steel.

Conventional aluminum anode cathodic protection designs are structurally incompatible with the rigors and stresses imposed during the launching operation and pile driving on platform jackets. Contact with a launching tether can dislodge the anodes. In early pile driving tests, sacrificial anodes fell off the jacket in large quantities, often removing large segments of platform structural members to which they were welded. In subsequent designs, the aluminum anodes had to be relocated to areas where the mechanical stresses from pile driving were minimized. Unfortunately, this often precludes locating anodes where they are required to optimize current distribution, for the prevention of corrosion in the "hidden" areas such as the reentrant angles of nodes.

Sacrificial anodes endanger diver and Remote Operated Vehicle (ROV) inspections since they obstruct the natural passageways through the tubulars on the underwater jackets. The anode projections obstruct freedom of movement and endanger the umbilicals of divers or ROV's. Even after the sacrificial anodes have been consumed, their core steel reinforcements remain. These anode remnants pose a life-threatening hazard to diver operations. If an impressed current cathodic protection system is used, it must be turned off to avoid diver electrocution.

Sacrificial anodes are heavy, adding approximately 6% to the platform jacket weight. This weight creates additional stress on the jacket, especially during the launching and uprighting operations. Even more important than weight, however, is the large cross sectional area of a sacrificial aluminum anode design. When acted on by ocean currents, the anode area creates a lateral force on the platform jacket. Lateral wave force acting on the anodes increases the overturning moment on the marine structure. This incremental overturning moment must either be compensated for (for example, by additional piles) or the designer must accept a reduced safety margin on the platform jacket.

Cathodic protection systems are a nuisance in well logging and similar data logging activities. The direct currents encountered from conventional cathodic protection systems must be "screened out" in order to interpret the logs. Impressed current cathodic protection systems are turned off before logging. It is not possible to turn off sacrificial anodes like aluminum when they are welded to the jacket.

Calcareous deposits (principally $CaC0_3$ and $Mg(OH)_2$) result from cathodic protection of steel in sea water. These deposits are generally beneficial in reducing cathodic protection current requirements over a period of time. However, these same calcareous deposits must be mechanically removed by divers during inspection for defects (e.g., pits or cracks) on critical areas. Such inspections are routinely performed by the operating companies and in some cases are mandated by regulatory bodies or insurance requirements.

Most designers of cathodic protection systems will add a safety factor of from 10% to as much as 100% dependent on the platform location and previous experience at that location. While safety factors cost money, experience has shown that underdesign is a more expensive alternative since underwater retrofit typically costs 10 to 100 times (dependent on water depth) the original installation cost.

Sacrificial and impressed current anodes are subject to variable behavior dependent on their environment and composition. Seawater temperature, pressure (depth), salinity, and water velocity may have a profound effect upon anode output, efficiency and life expectancy. It can, therefore, be seen that existing cathodic protection systems leave much to be desired.

In addition to the problems described above with existing cathodic protection systems, there is a serious problem with the removal of offshore marine structures. In the North Sea alone, the eventual cost of removal of 139 structures is estimated to be over ten billion dollars. In the Gulf of Mexico, over 3,000 existing structures eventually will require removal. In the prior art, the smaller offshore platform jackets weighing less than 3000 tons are generally removed by the use of large amounts of explosives which sever the jacket piles below the mud line. The platforms are then either floated or placed on barges and brought ashore. With this explosive process, the marine life, in particular fish and turtles which always thrive around offshore platforms, is destroyed.

For platform jackets weighing more than about 3000 tons, the existing alternatives for removal are to topple the platforms in situ with explosives or to provide navigational lights and to let seawater corrosion eventually topple and destroy the platform. Explosives destroy marine life and toppling poses a hazard to navigation since the base of a platform after toppling may protrude 300 feet or more.

Fishermen's nets, lines and trawler boards can become entangled with a toppled platform. Seawater corrosion at an average corrosion rate of 5 mils per year (0.005 inches) will likely take 100 to 300 years to topple most platforms. In the meantime, the platforms present a constant danger to navigation and to unauthorized personnel who trespass.

Consequently, an improved solution is required for the destruction of offshore structures whose useful life is over. The need is especially acute for destruction of deep water structures weighing over 3000 tons.

SUMMARY OF THE INVENTION

The present invention provides a substantially complete and instantaneous corrosion protection to the critical parts, such as the nodes, of an offshore platform. This corrosion protection is supplied by either ennobling or passivating the critical platform part and with cathodic protection current supplied to the ennobled or passivated critical part by the "untreated" or active parts of the submerged platform jacket. These untreated or active parts may be provided, for example, by non-critical tubular braces. The word "treated" as it is defined in the present invention refers to those critical parts, such as nodes, that have been ennobled or passivated by the apparatus and method of the present invention.

Examples of the apparatus and method of the present invention employed to make the nodes noble are applications of thin films of noble metals; for example, gold. Gold has a potential to a copper sulfate electrode (CSE) of about +0.2 volts in seawater. The untreated platform steel has a potential of about −0.6 volts to CSE in seawater. An example of passivation is the application of a Portland cement rich mortar or an elastomeric Portland cement rich mortar which will change the active (corroding) potential of the steel node substrate from around −0.6 volts to CSE in seawater to a more noble or passive (non-corroding) potential of around −0.2 volts CSE. The ennobling or passivating treatments may be used either separately or together, i.e., application of a thin film of gold followed by the application of a much heavier coating of an elastomeric mortar.

The present invention is, therefore, directed to the use of a rectifying type of coating that will permit direct electrolytic current flow to the nodes or critical area, but will not permit current discharge to the water from the nodes. The convention adopted in the description of the present invention is positive current flow which is opposite in direction from electron flow.

The present invention may also be used as a treatment application in a pre-assembly shop. After treatment the structural membering may undergo additional assembly, fabrication and then transportation to the underwater application The present invention in general covers metals, alloys, and other electronically conductive or semi-conductive materials for ennobling or passifying the substrate of critical areas of underwater structures. The invention is directed to those metals, alloys or materials having a more electropositive potential than steel in seawater with a range of from 0.05 to 2.5 volts. The present invention ordinarily will be used without any other form of cathodic protection such as aluminum anodes. However, the invention may be used with supplementary cathodic protection such as aluminum anodes if desired.

The present invention may also include the use of steel doubler plates and/or an organic dielectric shield beyond the "treated" area to reduce the corrosion rate of active parts immediately adjacent to "treated" parts. The invention may provide for the use of a protective shroud over the "treated" area to prevent mechanical damage during the installation, transportation and platform launching cycles. Subsequently, the crustacean-proof shroud may be removed by divers for underwater inspection of the critical parts. Subsequent to installation additional "treatment" may be applied to the critical parts using any known method. The invention may also provide for alteration on the surface of the critical parts which improves the mechanical and/or electrochemical performance of the "treatment".

Another aspect of the invention is a configuration which, when activated at the term of useful platform life, will either destroy or aid in the destruction of the marine structure through accelerated corrosion. The treatment of corrosion protection of the critical parts and the destruction of the platform by accelerated corrosion may be part of an overall system or may be used separately.

BRIEF DESCRIPTION OF THE DRAWING

A clearer understanding of the present invention will be had with reference to the following description and drawings wherein:

FIG. 1 illustrates a node in an underwater structure and with a prior art cathodic protection system using sacrificial anodes;

FIG. 2 illustrates a similar node in an underwater structure and using a cathodic protection system of the present invention;

FIG. 3 illustrates a rigid offshore platform jacket including the corrosion protection system of the present invention;

FIG. 3(*a*) illustrates in detail, a well casing template used in the platform of FIG. 3;

FIG. 4 illustrates a compliant offshore platform incorporating the corrosion protection system of the invention;

FIG. 5 illustrates a node which has been pretreated in accordance with the present invention as a first step in assembling an offshore platform;

FIG. 6 illustrates a second step in assembling the offshore platform by attaching tubular bracing;

FIG. 7 is a detail view of a portion of the structure of FIG. 6;

FIG. 8 illustrates an untreated node and the various electrochemical potentials at different points when in seawater;

DESCRIPTION OF THE PREFERRED EMBODIMENTS

Figure 9:
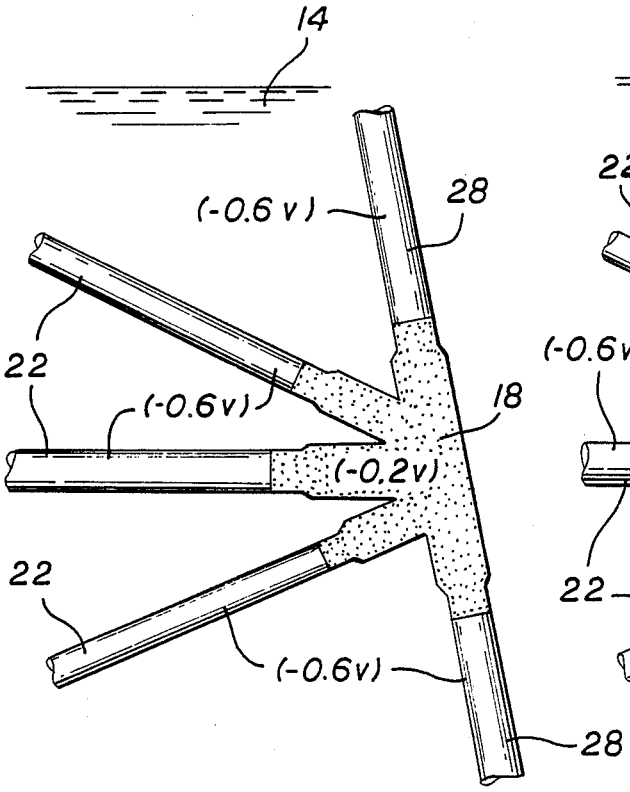
FIG. 9 illustrates a treated node and the various electrical potentials at different points when in seawater.

Corrosion protection provided by the present invention is greatly superior to existing cathodic protection utilizing sacrificial anodes. This is because in the "treatment" of the present invention, a noble metal film or applied coating instantaneously prevents corrosion on a critical part to which it is applied by acting as a barrier to oxygen and other corrodants in seawater. In addition, the ennobling or passivating effect of the "treatment" causes cathodic protection current to flow from the active and noncritical areas of the structure to the critical parts, such as nodes, thereby providing both substantially instantaneous and complete corrosion protection. FIG. 1 illustrates the prior art structure of providing direct current 10 emanating from sacrificial anodes 12 in a seawater electrolyte 14 but unable to protect reentrant angles 16 of a node 18. The invention is shown in FIG. 2 and provides protection of the reentrant angles 16 of the node 18.

In FIG. 2 protection results when direct current 20 flows from noncritical tubulars 22 through the seawater electrolyte 14 and into the deepest recesses of the reentrant angles 16 on the node 18 which has a coating 24 provided by the "treatment" of the invention. Improved corrosion protection thereby results from the triad approach of corrodant barrier, passivation and cathodic protection of the critical part. The cathodic protection of the critical part, such as the node, as shown in FIG. 2 is greatly superior to the cathodic protection shown in FIG. 1 for the three following reasons.

First, the amount of cathodic protection current required to protect the coated surface 24 in FIG. 2 is approximately one ten thousandth (1/10,000) that of the uncoated surface shown in FIG. 1. This permits the required small amount of current to penetrate into the deepest recesses of the reentrant angle 16 shown in FIG. 2. This is not possible as shown in FIG. 1 because the current 10 tends to travel the shortest path between the sacrificial anode 12 and the node 18, resulting in an insufficient residual current reaching the deepest recesses of the reentrant angle 16. Second, current distribution in the present invention is superior because of the favorable anode to cathode spatial geometric relationship. This is because in the invention the anode, which are the noncritical platform parts such as the tubular members 22, surrounds the cathode, which is the critical platform part such as the reentrant angles 16, and the current paths are relatively short, whereas the current paths are relatively long between the aluminum sacrifical anodes 12 and critical parts such as the reentrant angles 16. Third, the large anode to cathode ratio of the invention (about 5:1) favors improved current distribution over the prior art sacrifical aluminum anode approach where the anode to cathode ratio is approximately 1:100.

The risk of hydrogen embrittlement of certain high strength steels used in the critical components of offshore marine structures is either completely eliminated or greatly reduced since the invention employs the noncritical steel members of the structure as anodes. It is generally accepted that the less electronegative an anode material, the less likely is hydrogen embrittlement of high strength steels. Aluminum anodes commonly used in the prior art are commonly −1.1 to −1.2 volts to CSE, whereas the active steel anodes in noncritical platform members are typically −0.6 volt to CSE.

The flexible and abrasion resistant ennobling films and elastomeric mortars of the present invention are inherently resistant to mechanical damage. As an example, mechanical damage can result from the shock waves produced by pile driving forces which can exceed 200,000 ft.-lbs. per blow and from the steel wire rope tethers commonly utilized in platform jacket uprighting procedures. Also, in the rare event of "treatment" damage, a field or underwater repair can be made much more easily and with less cost than would be the case for rewelding or reclamping a replacement aluminum anode.

The "treatment" of the present invention does not protrude, block natural underwater passages between the structure bracing, hinder mobility, or pose a hazard to diver or ROV umbilicals used in periodic inspections of the jackets as do aluminum anodes. In addition, the "treatment" of the invention adds no significant weight to a platform jacket as opposed to aluminum anodes which add about 6%. Further, the "treatment" of the present invention adds no measurable underwater area to the platform jacket as do aluminum anodes. Therefore, the invention eliminates the additional overturning moment caused by ocean currents acting on the incremental area of the aluminum anodes.

The cathodic protection currents flowing from the active noncritical steel tubulars 22 to the elastomeric mortar covered or noble covered surfaces 24 of the critical parts, such as nodes, will be approximately one ten thousandth (1/10,000) that supplied by prior art cathodic protection systems. This insignificant amount of current produced by the invention "treatment" will not be a nuisance to data logging activities, such as well logging, unlike conventional cathodic protection systems.

Approximately one ten thousandth (1/10,000) the normal amount of calcareous deposits are produced on the critical node parts as a result of the invention since the current densities on the elastomeric mortar covered or noble covered nodes will be only about one ten thousandth (1/10,000) that produced by conventional cathodic protection. Thus, diver or ROV inspection of critical platform parts, such as nodes, can be made visually without the expensive and time consuming job of calcareous deposit removal, as will be the case with conventional cathodic protection. Also, when a protective shroud is added over the "treatment", the subsequent removal of the protective shroud will exfoliate any marine crustaceans formed at shallow depths, permitting unobstructed visual examination by the diver. A combination of these factors means that the use of the invention will permit improved inspection of critical areas on marine structures with less expense than would be the case if conventional cathodic protection systems are used. Thus the structural safety of the marine structure is improved at less cost by using the present invention. These inspections are routinely performed by operating companies and in some cases are mandated by regulatory bodies or insurance requirements.

The enormous costs of either underdesign or overdesign of corrosion protection, particularly of new oil reservoirs in deep water or locations with unusual environments, can largely be overcome by the use of the present invention compared to conventional cathodic protection. Underdesign is avoided because of the invention's triad effect of ennobling or passivation, cathodic protection and barrier coat. The barrier coat results in only about 1/10,000 the cathodic protection current requirement of conventional cathodic protection systems. Even if there were an increase of a hundredfold in cathodic protection current requirements for the present invention, this is acceptable since the anode to cathode ratio is normally approximately 1,000,000 times that of aluminum anodes.

In a conventional aluminum anode protected structure, the anode to cathode ratio is about 1:100. The barrier coat of the present invention results in allowing only 1:10,000 the normal cathode surface to be exposed. Therefore, the resultant anode to cathode ratio is calculated from the product; i.e. $1/100 \times 1/10{,}000 = 1/1{,}000{,}000$.

The passivation or ennobling mechanisms of the invention are essentially not affected by pressure (depth), salinity, oxygen content, water current velocity, biological activity or suspended particulate matter as are the prior art cathodic protection schemes. Both impressed current and sacrificial anodes used in the prior art are prone to deactivation, which results in either reduced or no current output, lowered anode efficiency and reduced life expectancy due to compositional effects and environment. The proper functioning of the invention is not dependent on composition or environmental effects.

Sacrificial anodes employed in the prior art cannot be used in the destruction of offshore marine platform jackets whereas the invention can be used to dismember and destroy a marine platform after its useful life has been reached.

FIG. 3 schematically represents a rigid offshore platform jacket 26 provided with the improved corrosion protection coatings 24 of the invention. FIG. 3 illustrates the conventional jacket substructure 26 of an offshore platform which includes tubular cross braces 22 and legs 28, nodes 18 and piles guides 30. The platform also includes well casing templates 32 and, as shown in detail in FIG. 3(a), these include guide cones 34, and surface casing 36 surrounding well casings 38 and production strings 40. The "treatment" of the invention is applied to critical parts such as the nodes 18, the exterior 42 of the surface casing 36 inside the guide cones and on the interior 44 of the guide cones 34.

In FIG. 4, another configuration of the present invention is shown on a compliant offshore platform of the type referred to as a tension leg platform (TLP). This type of platform consists of a jacket 46 which includes vertical columns 48 and horizontal pontoons 50 reinforced with tubular bracing 52, some of which may contain nodes 54. Surface casings 56 surrounding the wells and production pipes extend from the drilling deck to the ocean bottom through a well template 58 containing guide cones 60. The buoyant jacket is tethered by lateral moorings 62, which may be temporary, and restrained vertically by high strength steel tendons 64 which extend from attachments in the vertical column to attachments on foundation templates 66, which are secured to the sea floor by driven piles. In the TLP, the treatment of the invention is applied to the tendons and tendon attachments to both the foundation template and vertical columns. In addition, the treatment is also applied inside the guide cones and to a small area of surface casing passing through the guide cones in the well template. Further, other critical submerged components, such as nodes, and internal portions of hawsepipes and the like are also treated.

The "critical" parts on these structures are those parts which are subjected to high stress levels and are generally composed of high strength steels. Additionally the term "critical" refers to the interior of well casing guide cones and the exterior of surface casings inside these cones. In the past it has been impossible to protect these parts with cathodic protection. The marine structures which may be protected by the treatment of the present invention include compliant structures, such as the TLP, tethered buoyant platform or the "guyed" tower structures, and rigid structures and shallow water structures such as structures built with sheet piles. Other marine structures which may be treated are submerged production systems, sea drone type structures and other underwater structures, offshore storage facilities, marine radar stations, semi-submersible drilling barges, jack up barges, underwater pumping and separator stations, and the like. Although the details of the invention will vary dependent on specific geometry of the structure protected and critical components employed, the principal features will be substantially the same, regardless of the type of offshore structure protected.

An embodiment of corrosion protection system employed on the offshore structure is shown on the node 18 in FIG. 5. This node will undergo the proper surface preparation by sandblasting, shotblasting or other suitable means. Over this prepared surface and extending from the noncoated stub-offs 68 of the node, the balance of the node is coated with a thin film primer 70 consisting of an organic polymer supersaturated with Portland cement. This primer is applied in a coat or coats and as an example may be approximately 10 mils thick. The thickness range may vary depending upon the desired level of protection and can have a range between 0.5 to 250 mils.

The alkalinity and high pH of the cement passivates the substrate, which in the embodiment of FIG. 5 is the steel surface of the node 18. Elastomeric mortar 72 is then applied approximately 1/4 inch thick in single or multiple coats over the elastomeric mortar primer. The thickness range of the elastomeric mortar may also vary and may have a range between 0.01 to 12 inches. The elastomeric mortar also is supersaturated with Portland cement. The organic polymer mortar primer is applied primarily to passivate the surface of the node. The elastomeric mortar is applied in a heavier buildup to protect against carbonation and mechanical damage to the coating system. Both the primer and the top coat are sufficiently flexible to withstand the mechanical stresses encountered in the handling, launching, pile driving, and thirty years of cyclical wave action.

After the application of the two component passivating coating system, the node 18 is then transported to the graving dock, or yard, where the marine platform is being assembled. Tubular bracing including cross braces 22 and legs 28 are welded to the node 18 in the assembly yard as shown in FIG. 6. After surface preparation, the same two component system 76 is applied over the heat affected zone (HAZ) 74 to a distance a few inches to several feet beyond the HAZ 74 on the tubular as shown in the detail view of FIG. 7 which shows the circled area of FIG. 6. The elastomeric mortar system described in the present invention is capable of withstanding severe abrasion and is highly resistant to impact. However, should any mechanical damage to the coating occur, a field repair may be made with the elastomeric mortar.

After fabrication is completed, the platform jacket is either floated out or placed on a barge and towed out to a predetermined location in the ocean. In the case of the rigid template structure, the jacket is then uprighted by selective sequential flooding of ballast compartments within the jacket. The jacket is ballasted and lowered to the ocean bottom, usually guided by tethers from supporting marine craft. Subsequently, piles are driven through the legs or skirt pile guides. Should any damage occur to the elastomeric coating system during the placement underwater, the damage is repaired by a third compound, which may be epoxy mortar or similar material. This mortar is applied underwater by divers or by use of remote operated vehicles (ROV).

After submersion of the platform, a minute amount of water electrolyte will penetrate into the coating system of the invention. This results in a saturated solution of calcium hydroxide being formed on the substrate of the critical part, such as the node. The high alkalinity and pH of the calcium hydroxide causes passivation of the steel substrate. Passivation changes the potential of normally active steel from around 0.6 volt negative relative to a copper sulfate cell (CSE) to about 0.2 volt negative to CSE. FIG. 8 shows the active condition of the uncoated node 18 and tubulars 22 and 28 in seawater 14 prior to the application of the invention. FIG. 9 shows the passive condition of 0.2 volt negative to CSE of the coated node in seawater 14 after the application of the coating 24 of the invention. Note that the untreated tubulars remain in the active condition. In this passive state no corrosion of the steel substrate on the critical node part can occur.

Figure 10:
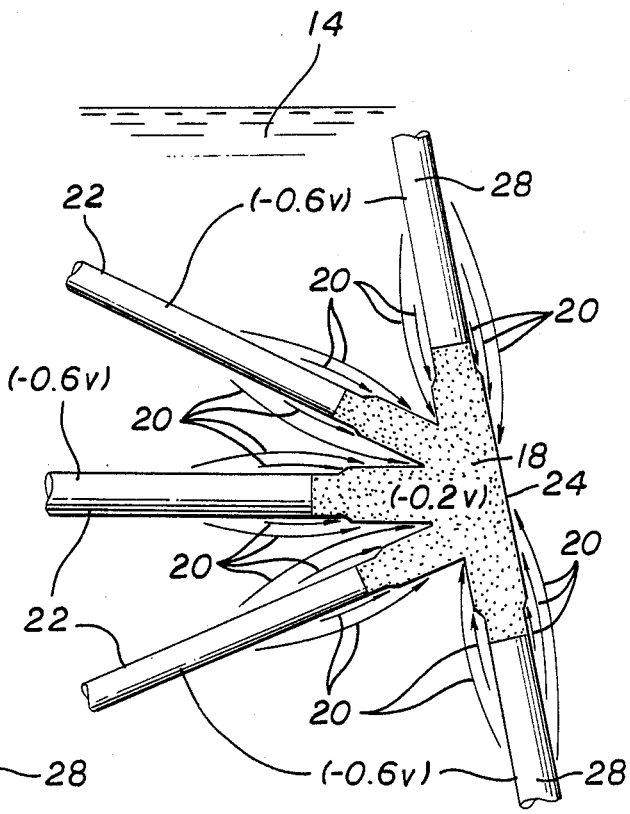
FIG. 10 illustrates the node of FIG. 9 and shows the current flow in accordance with the electrochemical potentials.

The nodes on a typical jacket structure constitute approximately 15% of the total underwater area of the platform jacket. The balance of the jacket is made up of noncritical tubular legs 28 and braces 22. These noncritical areas will remain at an active potential of around 0.6 volt negative to CSE. The difference in the potential between the passivated critical nodes and the active areas is approximately 0.4 volt. Consequently, the noncritical areas 22 and 28 are anodic and provide the cathodic protection current 20 to the passivated node areas 18 as shown in FIG. 10. This has the dual benefit of providing cathodic protection and generating alkalinity at the passive areas on the nodes as expressed by the following electrochemical equation:

$$2H_20+0_2+4e^- \rightarrow 4OH^-$$

The longevity, such as a life of over 30 years for the coating system of the present invention, is partly dependent on the continuous regeneration of alkalinity that occurs as a result of cathodic protection of the passivated nodes. The balance of the alkalinity is incorporated within the "treatment". Likewise, the passivation of the critical parts such as by the coating system of the present invention results in an electropositive shift of potential with the result that the critical parts become cathodic to the anodic active areas as shown in FIG. 9. The difference in potential between the active and passive areas results in cathodic protection of the passive area as shown in FIG. 10.

The present invention produces a synergistic effect of cathodic protection, providing alkali which passivates the substrate and with the passivation resulting in a positive change of potential and with the difference of potential between the active and passive areas providing the driving voltage, which is the basis for cathodic protection. A large anode to cathode area relationship is also beneficial for the optimum continuing generation of alkalinity at the critical node areas. The nodes represent about 15% of the area of a typical jacket with the noncritical active areas of the jacket representing the approximately 85% balance. The anode to cathode area relationship is therefore approximately $85 \div 15$ or approximately 5.7. This favorable anode to cathode ratio therefore contributes to the advantages provided by the present invention.

It is to be appreciated that variations of the first embodiment of the invention may be made so that the primer coat or the top coat may be used alone. Also, a cement rich slurry coat (a rich mix of Portland cement and water) may be used as a primer while the top coat may be Portland cement mortar and/or reinforced concrete with a thickness variation of 0.01 inches to 12 inches of mortar or concrete.

Figure 11:
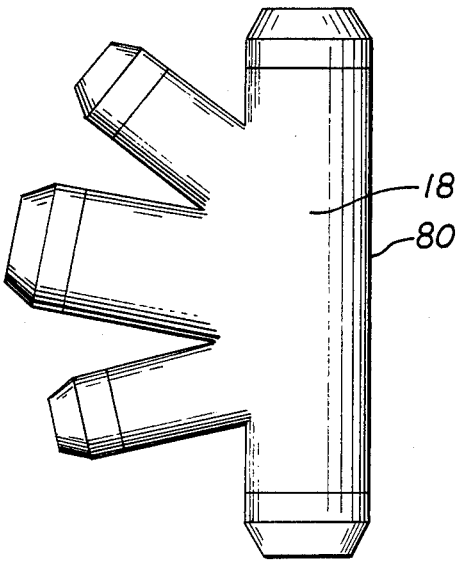
FIG. 11 illustrates a node treated by the application of a noble coating.
Figure 12:
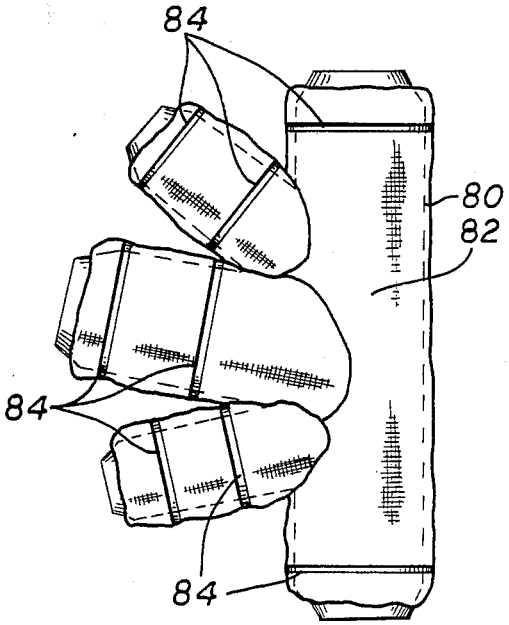
FIG. 12 illustrates the node of FIG. 11 with an additional protective shroud.

In a second embodiment of the invention, gold 80 or other noble material is applied to the node 18 after heat treatment as shown in FIG. 11. The gold application method is not important and can be of any known method such as electroplating, chemical plating, mechanical plating, etc. The gold film would be typically one millionth of a millimeter ($1 \times 10^{-6}$ mm), but a thickness range of $1 \times 10^{-8}$ mm to 1 mm may be provided. Since the gold film is quite thin, it could be mechanically damaged. To prevent this damage, a protective shroud 82, as shown in FIG. 12, is placed over the ennobling gold film. An example of the shroud is a heavy coal tar reinforced glass wrap similar to rock shields that protect underground pipe coatings. The protective shroud 82 is placed over the gold coating and can be secured with plastic or stainless steel bands 84 as shown in FIG. 12. This protective shroud is not bonded to the gold film, but mechanically secured over the gold film.

Figure 13:
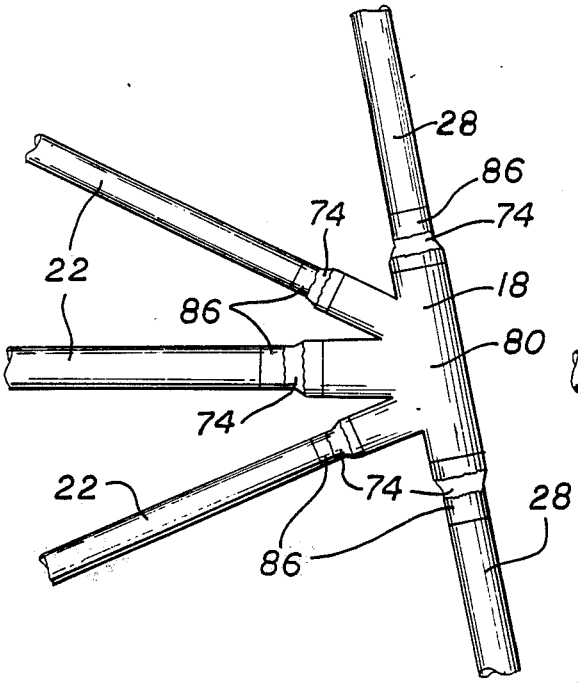
FIG. 13 illustrates the node of FIG. 11 partially lg fabricated with tubular braces.

After the node is welded to the tubular braces 22 and 28 in the fabrication yard, a similar gold coating 86 is applied over and beyond the HAZ 74 on the tubulars 22 and 28 as shown in FIG. 13. The protective shroud also can be extended over this additional gold coating for mechanical protection. Repair of any mechanical damage to the gold in the atmosphere can be effected with gold or the elastomeric mortar. Repairs to the gold underwater can be by epoxy mortar. After the platform jacket has been set in the ocean, the critical part, such as the node, can be inspected by divers by cutting the plastic or steel retaining bands 84 and removing the protective shroud 82 over the gold coating. Because the gold coat is very thin, the most minute cracks in the node can be easily observed visually by photographs or underwater TV monitors.

The protective shroud 82 performs a variety of additional functions in addition to protecting the thin ennobling films from mechanical abuse. Specifically, the shroud 82 is a barrier against carbonation of coatings containing cement. The shroud also retards calcareous deposits on the thin film coatings and prevents the deposition of marine fouling on the thin film coating. Marine fouling such as crustaceans can form on the shroud but not on the underlying thin film coating. When the shroud is removed, all the marine fouling is exfoliated. All of these embodiments reduce the time and improve the quality of required underwater inspections by divers or by Remote Operated Vehicles. Consequently, the safety of the platform is improved and the cost of underwater inspections is reduced.

The passivation embodiment and the noble coating embodiment may be used separately or together. Other noble metals or alloys also may be used in addition to or in place of gold. In addition, other materials (for example, graphite or semiconductors) also can be used in lieu of or in addition to the materials specified above to make the critical parts electrochemically noble or passive relative to the noncritical parts. These materials must be in electronic contact with the critical part to be protected. Also, rectifying coatings, which are coatings which will allow direct current to pass undirectionally, may be used in addition to or in lieu of the previously described ennobling or passivating coatings.

With the present invention, prevention of accelerated corrosion of noncritical parts adjacent to the "treated" critical parts normally will not be necessary. The following example relative to the prior art sacrificial anodes provides some perspective. For example, on a particular platform structure in 300 feet of water, about 580 aluminum anodes weighing 290 tons would be required in a specific location. Using the present invention, the total loss of steel to provide cathodic protection to the "treated" nodes on the same particular platform is estimated at approximately 150 lbs. of steel in 20 years. On the other hand, the total amount of corrosion of the same platform that would occur on the noncritical areas simply due to the normal corrosion rate of steel in seawater is approximately 547 tons of steel in 20 years. Therefore, the additional loss of steel to provide cathodic protection to the "treated" critical areas represents only 0.0015 percent of the total weight loss from corrosion.

Figure 14:
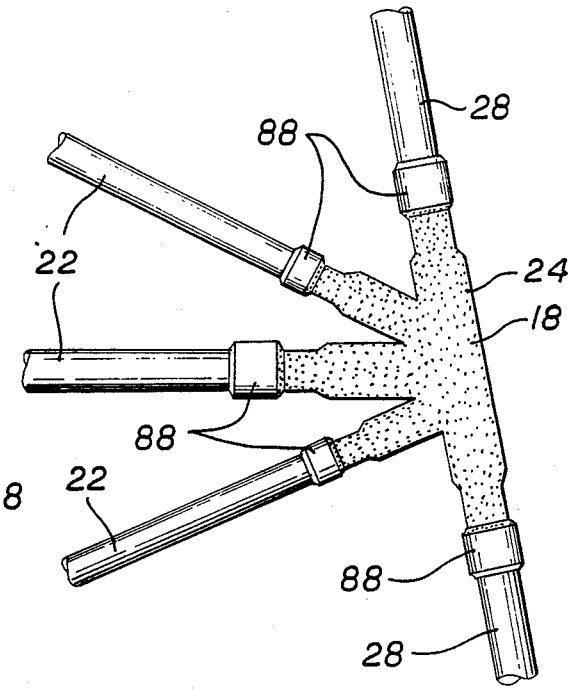
FIG. 14 illustrates a treated node of the present invention including further corrosion protection using doubler plates.
Figure 15:
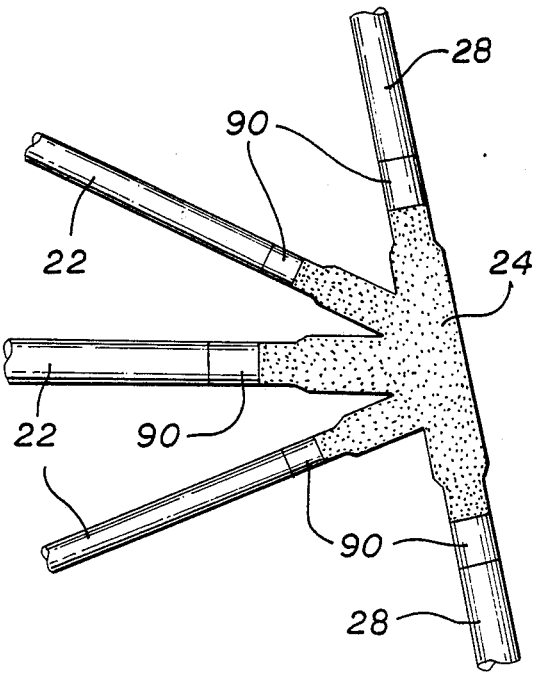
FIG. 15 illustrates a treated node including further corrosion protection using dielectric shields.
Figure 16:
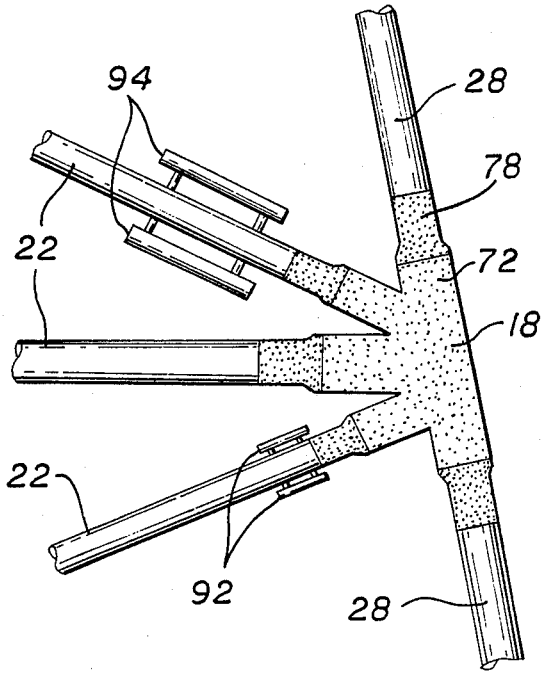
FIG. 16 illustrates a treated node including further corrosion protection using conventional sacrificial anodes.

The prevention of accelerated corrosion to the noncritical members of the structure at the juncture of the critical versus noncritical areas also can be prevented by the use of doubler plates 88 welded between the critical nodes 18 and noncritical tubulars 22 and 28 as shown in FIG. 14, by dielectric shields 90 as shown in FIG. 15 or by very small sacrificial anodes 92 or conventional sacrificial anodes 94 as shown in FIG. 16. Combinations of these methods are also possible as shown in FIG. 16 using shop applied mortar coating 72 over the node and field applied mortar 78 over the HAZ.

The extension of the invention "treatment" beyond the critical part and even beyond the HAZ provides accessible inspection points for diver or ROV evaluation by destruction of the "treatment" on the noncritical parts such as the overlap on the tubulars 22 and 28. The "treatment" described in this invention will resist abrasion, handling damage, launching stresses, and, after seawater immersion, pile driving stresses and wind wave forces acting on the platform for 30 years.

Cathodic protection current distribution from the noncritical to the critical parts in the present invention is greatly superior to the prior art as described above. The superior current distribution permits instantaneous and complete corrosion protection of the recessed or "hidden" parts, such as the reentrant angles 16 of the nodes 18 shown in FIG. 2. One reason why the invention results in such excellent current distribution is because the critical part, such as the node, is coated and has a current requirement only 1/10,000 of the amount of cathodic protection current required on an uncoated node. Also more cathodic protection current is available since the noncritical area to critical area ratio is about 5:1 versus the usual anode to cathode ratio of conventional sacrificial anodes to the offshore platforms which is about 1:100. The combination of these two factors results in an improvement of the invention over the prior art based on area relationships of about 500:1.

Finally, the favorable geometry between the anode (active) and cathode (passive) in the invention makes it possible for cathodic protection current to pass from the large anode, consisting of the noncritical tubular cross braces 22 and legs 28, which completely surrounds the passive node, over the shortest possible distance to the reentrant angles 16 of that node. Conventional sacrificial aluminum anodes have a longer distance to "throw" their current because they cannot be welded on the node and are too large to be placed inside the tight recesses of the reentrant angles where they are needed most. A combination of all these factors results in the invention being able to protect critical areas substantially instantaneously, whereas these same critical areas either can never be protected or will take longer to protect utilizing the corrosion prevention schemes of the prior art. Failure to achieve substantially instantaneous corrosion protection of a critical part dramatically increases the probability of corrosion fatigue and/or stress corrosion cracking (SCC). Either of these two corrosion mechanisms can result in a catastrophic failure of the critical part. Repair of such a failure offshore could cost several hundred million dollars on a jacket such as in 1000 feet of water.

Application of the noble film or passivating "treatments" may be made as a shop coat on the critical parts prior to erection or it may be made during or after erection in the fabrication yard or it may be made underwater as a retrofit on platforms with depleted conventional sacrificial anodes or as a repair to an existing corrosion protection system. This versatility offers substantial savings over prior art corrosion protection schemes.

The noble or passivating "treatments" may also be applied to critical parts over surfaces that have been deformed or serrated to improve the "treatment". For example, the ability of cement mortar to adhere to a part under certain types of stress or duress during handling, or pile driving, would be improved by having a serrated or deformed anchor pattern on the surface of the critical part. Another way of securing the mortar to the critical part substrate is with steel rods or wire reinforcement such as chicken wire embedded in the mortar.

Figure 17:
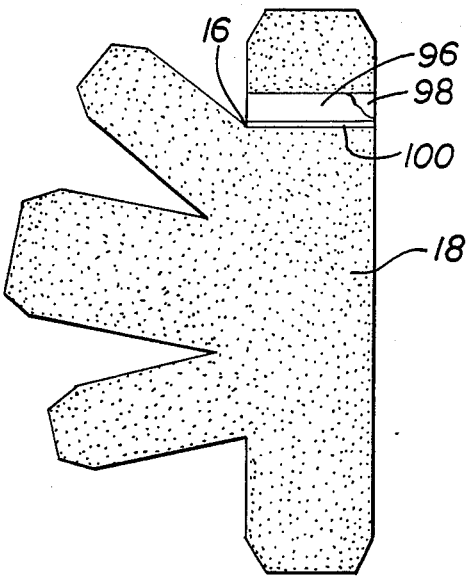
FIG. 17 illustrates a treated node and incorporating a structure for providing for accelerated corrosion when desired.

The present invention can also include for the destruction of the platform by accelerated corrosion when desired. Specifically, within the most critical area of a platform critical part, copper foil 96 may be placed around the node perimeter and be tightly banded to make metallic and electronic contact with the surface of the critical part as shown in FIG. 17. The position for the copper foil may be the sandblasted surface of the most highly stressed area of the node. As a further variation, the copper foil 96 may be placed over a gold substrate 98 on the node 18 as shown in FIG. 17. The copper foil and/or gold substrate has a slit and/or groove 100 extending for most of the circumference of the critical member. This slit and/or groove will vary dependent on application and materials employed but may vary from 0.00001 inch to 1 inch in width. Other noble metals or alloys such as gold or cupronickel may be substituted for copper in thickness varying from a few angstroms to one inch in thickness. In still another variation nonmetallic but electronically conductive materials such as graphite or iron oxides may be substituted for the copper.

Over the copper foil is placed stainless steel braid 104 which is attached to a stainless steel pull bar 110. The purpose of the stainless steel braid and pull bar is to provide a subsequent method of removal of the braid to expose the copper foil surface to the seawater environment. Alternative methods which accomplish the subsequent exposure of the copper foil to the environment may also be used. The passivating elastomeric mortar of the invention is placed over the stainless steel braid. Dependent on the thickness of the braid, the elastomeric mortar will cover the stainless steel braid with a minimum thickness of 0.250 inch to 1.00 inch, with an overlay thickness of 0.500 inch being typical.

When the platform has reached the end of its useful life after all of the recoverable oil has been removed from the reservoir, divers will attach pull lines or tethers to the stainless steel braid. The pull lines then are attached to a suitable prime mover on the platform or supporting marine craft. The prime mover is engaged to pull on the stainless steel braid. Removal of the stainless steel braid by pulling will dislodge the overlying elastomeric mortar, thereby exposing the copper substrate. The copper foil 96 has the narrow slit 100 approximately 0.005 inches in width running nearly the whole circumference of the critical member, such as the node.

The slit 100 has approximately 1/10,000 the area of the exposed copper. Such a high cathode to anode ratio will ensure a galvanic corrosion rate of about 0.3 inches per year on the most critical point of the steel node, which is exposed by the narrow slit 100 in the copper foil 96. The resulting narrow, deep corrosion groove will cause premature failure of the node at this point. Positioning this accelerated galvanic corrosion on a critical part, such as the node, at the point of highest metallurgical stress will initiate stress corrosion cracking (SCC) and/or corrosion fatigue. The SCC corrosion mechanism proceeds at the rate of about one half inch per hour with the result that even a structural member with a wall thickness of several inches will fail within several hours. Certain chemicals such as ammonium bicarbonate also are known to increase susceptibility to SCC. Such chemicals can be applied by a diver or by a ROV as a component of a slow leaching underwater putty if necessary to initiate SCC. The application of slowly released agents or chemicals to initiate or accelerate SCC or corrosion fatigue can therefore enhance this aspect of the invention.

To avoid the hazard caused by unauthorized personnel who might attempt to surreptitiously board an abandoned platform, it may be necessary to hasten the destruction of the platform by using suitable explosives such as shaped charges. The use of the galvanic corrosion cell, corrosion fatigue and SCC described in the present invention to corrode the critical part and cause premature failure will greatly reduce or eliminate the amount of explosive required at each location. Also, explosives will be required at fewer locations. Reduced time by divers and/or ROV's because of the accelerated destruction of the platform by the present invention will result in large economic savings in platform removal. The present invention also improves the final demise of the platform from an ecological standpoint since fewer fish, turtles and other marine life will be killed because fewer and smaller explosive charges will be required for platform removal.

The following is a step-by-step description of the platform destruction by accelerated corrosion caused by this aspect of the present invention.

Figure 19:
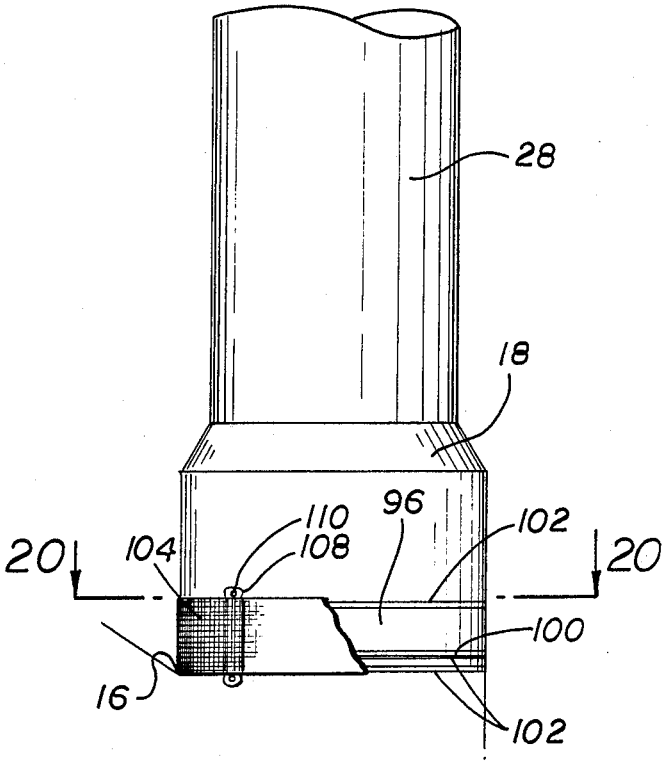
FIGS. 18 and 19 illustrate details of FIG. 17 showing the operation of the accelerated corrosion mode.
Figure 18:
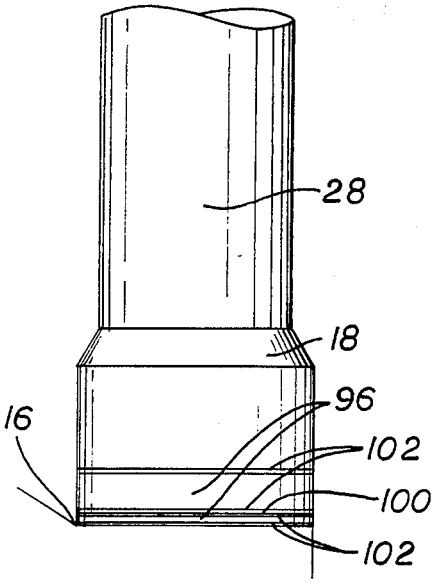
Figure 20:
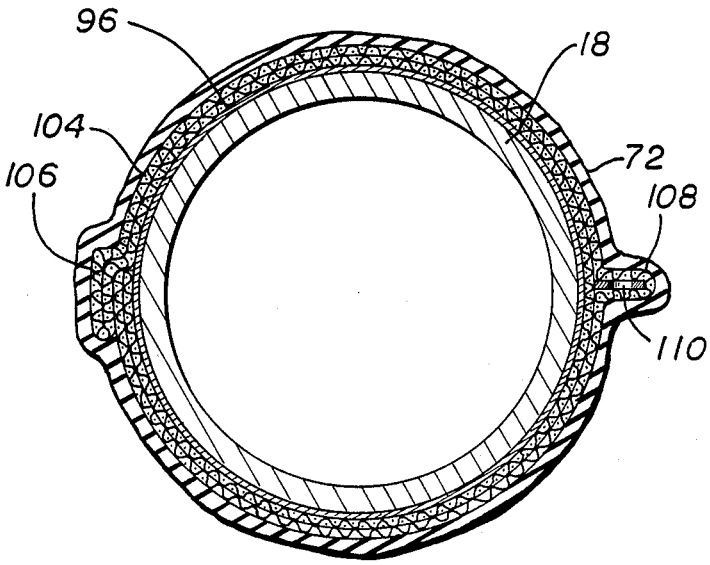
FIG. 20 is a cross sectional view taken along lines 20—20 of FIG. 19.
Figure 21:
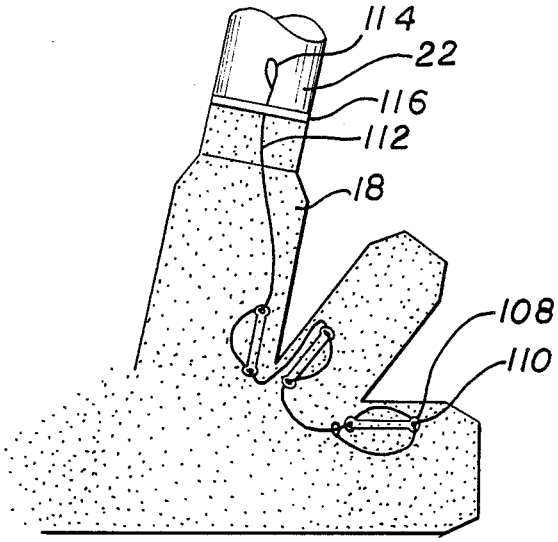
FIGS. 21 and 22 illustrate the structure for actuating the acceleration mode for electrochemical destruction of the entire platform.

During the original platform construction, the surface at the area of the node with the highest metallurgical stress is prepared by shot or sandblasting. In the example described, this is assumed to be at the V notch inside the reentrant angle 16 of the node 18 as illustrated in FIG. 18. The copper foil 96 is placed over the prepared surface and banded to it tightly with the stainless steel bands 102 to ensure good electronic contact with the surface of the node as shown in FIG. 18. The copper foil has the slit 0.005" wide which extends over 95% of the node circumference. This slit 100 is placed over the node area of highest metallurgical stress. A stainless steel braid 104 is then folded over the node 18 at position 106 shown in FIGS. 19 and 20. This braid normally has a rupture strength of at least five times the force required to remove the subsequently applied coating 72. A stainless steel pull bar 108 is placed within the stainless steel braid. The coating of the invention, such as the elastomeric coating 72, is then applied one half inch over the braid as shown in FIG. 20, leaving only pad eyes 110 of the pull bar 108 exposed. Prior to jacket launching, a stainless steel sling 112 is threaded through the pad eyes 110 of the pull bars 108 as shown in FIG. 21. A pull loop end 114 of the sling 112 may be carefully secured to a structural member such as a tubular brace 22 by plastic banding 116 or other suitable means in such a way as to minimize danger of premature release during the transportation and launching phases of the jacket.

Figure 22:
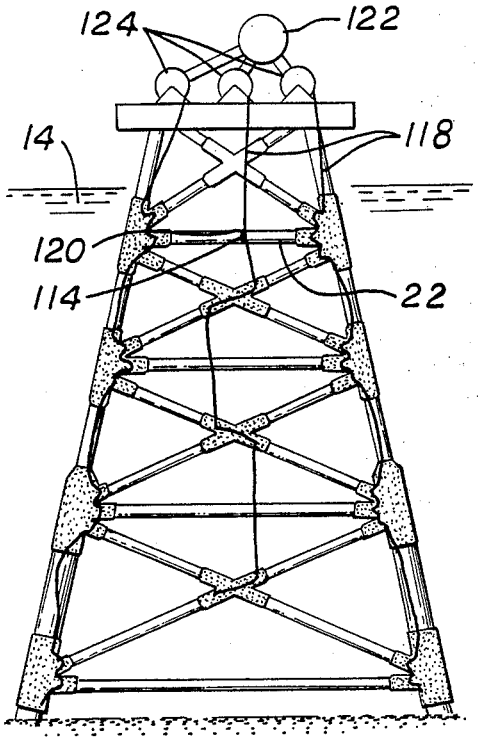

At a later time, such as thirty years later, the oil reservoir of the production field normally will be depleted and the platform has served its purpose. The destruction of the platform by corrosion now will be initiated. A diver or ROV attaches a tether or pull line 118 by shackle 120 or other suitable means to the pull loop 114 as shown in FIG. 22. A winch 122 is activated at the topside end of the pull lines 118 as wrapped around pulleys 124. The winch 122 pulls on the pull lines 118 attached to the pull loops 114 and stainless steel braids 104. At each location, as the stainless steel braid 104 unfolds, the overlying elastomeric coating 72 is removed, thus exposing the underlying copper foil 96 to seawater 14.

Figure 23:
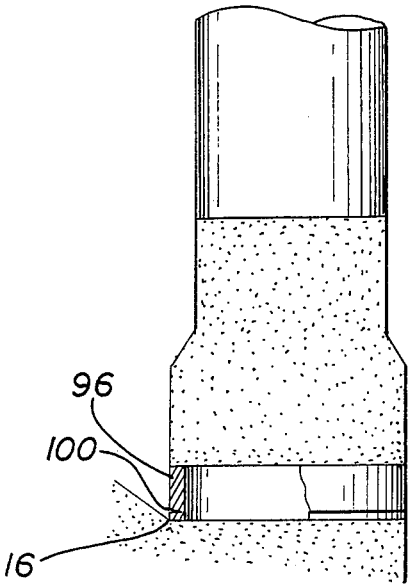
FIG. 23 illustrates the initial point of corrosion in the acceleration mode.

As shown in FIG. 22, a number of pull loops 114 may be attached to a single pull line tether 118. Rigging the pull line tether 118 by passing the pull line tether though the pull loops 114 of the stainless steel slings 112 located at different levels, as shown in FIG. 22, results in the sequential removal of the stainless steel braids 104 and initiation of accelerated corrosion starting at the lowest levels and progressing upward sequentially. Such rigging and sequential removal minimize the required torque applied by the winch 122. Accelerated galvanic corrosion then ensues at the narrow slit 100 on the most critical notch area 16 of the node 18 as shown in FIG. 23.

The method for dislodging the elastomeric coating, exposing the slit in the copper foil and initiating accelerated corrosion, may vary depending on conditions. For example, the method described above wherein the tethers 118 are attached only shortly before platform destruction provides for a certain amount of abuse in the platform launching operation and protects against sabotage. A far less expensive method which minimizes diver time would be to join all pull loops 114 to tethers 118 and terminate the tethers at −100 feet mean low low water (MLLW) before platform launching. When it is time for platform destruction, the divers only have to make a shackle connection to the tethers at −100 feet MLLW and connect to a topside winch. The more expensive described method is designed to prevent accidental dislodgement of the stainless steel braid during platform launching and similar operations. Also, terrorists attempting to sabotage a platform by premature exposure of the copper foil would require sophisticated deep ocean diving equipment in the more expensive method.

Figure 24:
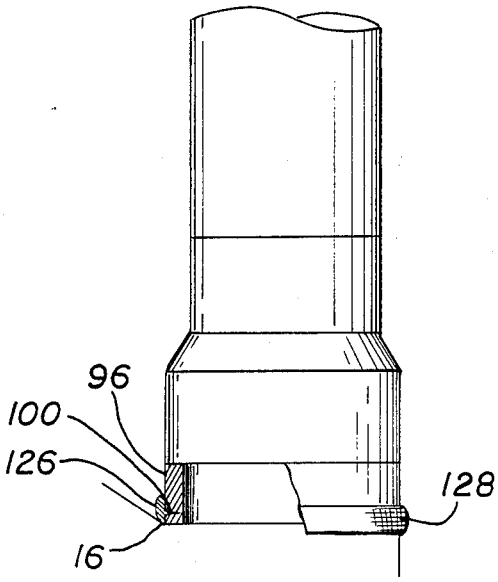
FIG. 24 illustrates a galvanic coupling to enhance the corrosion in the acceleration mode.

SCC and/or corrosion fatigue may also be initiated by diver or ROV application of chemicals such as ammonium bicarbonate which are placed around the narrow corroding slit in a semipermeable bag 126 as shown in FIG. 24. These chemicals are contained in an underwater putty 128 within the bag 126 designed to slowly leach out the chemicals at an optimum rate. The ensuing corrosion fatigue and/or SCC causes severe structural weakening and/or failure of the critical member.

The number of critical areas on a node and the number of nodes equipped with the accelerated corrosion devices of this invention may vary from platform to platform and be dependent on the time interval acceptable for platform collapse, the degree of metallurgical stress in the critical member and the transfer of stress from one critical member to another as the first critical member collapses. The number of critical members so equipped with the accelerated corrosion devices of the invention can be minimized by taking advantage of the sequential failure mode that results on critical members not equipped with accelerated corrosion devices of the invention because of the unacceptably high loads transferred when critical members equipped with the invention collapse. In some cases, platform toppling may require some explosives. For example, a shaped charge may be used to initiate platform collapse in addition to the structural weakening caused by the accelerated corrosion attack.

Even after platform toppling, the sea floor base level of some jacket platforms may exceed 300 feet. Such a protrusion from the sea bottom would be unacceptable over a long period of time because of the hazard to marine traffic. However, the use of the invention would greatly reduce the time for breaking up of the platform sections into smaller segments which are innocuous to submarine traffic, marine life, fishermen's cables, trawler boards and the like.

Although the invention has been described with reference to particular embodiments, it is to be appreciated that various adaptations and modifications may be made and the invention is only to be limited by the appended claims.

I claim:

1. A corrosion protection system for protecting critical parts of an offshore structure wherein the structure is composed of an assembly of critical parts representing a small portion of the structure and noncritical parts representing a large portion of the structure, including means for coating the critical parts with a layer of material having a composition to form a noble or passifying protective treatment so that the critical parts are made electrochemically noble or passive relative to the uncoated noncritical parts when the offshore structure is submerged, and the noncritical parts being electrochemically active relative to the coated critical parts to provide for cathodic protection current supplied to the coated critical parts by the uncoated active parts to produce corrosion protection to the coated critical parts.

2. The corrosion protection system of claim 1 wherein the protected critical parts include the node members of an offshore platform.

3. The corrosion protection system of claim 1 wherein the protected critical parts include tension members of an offshore platform.

4. The corrosion protection system of claim 1 wherein the protected critical parts include portions of a well casing template of an offshore platform.

5. The corrosion protection system of claim 1 wherein the layer of material is a passive coating.

6. The corrosion protection system of claim 5 wherein the passive coating is an elastomeric mortar.

7. The corrosion protection system of claim 6 wherein the elastomeric mortar includes Portland cement.

8. The corrosion protection system of claim 7 wherein the Portland cement is supersaturated in the elastomeric mortar.

9. The corrosion protection system of claim 6 wherein the passive coating has a thickness in the range of 0.01 to 12 inches.

10. The corrosion protection system of claim 6 wherein the passive coating has a thickness of approximately 0.25 inches.

11. The corrosion protection system of claim 6 additionally including a thin primer coat of mortar on the critical parts before the coating of the layer of elastomeric mortar.

12. The corrosion protection system of claim 11 wherein the primer coat is an organic polymer containing Portland cement.

13. The corrosion protection system of claim 12 wherein the Portland cement is supersaturated in the organic polymer.

14. The corrosion protection system of claim 11 wherein the primer coat has a thickness in the range of 0.5 to 250 mils.

15. The corrosion protection system of claim 11 wherein the primer coat has a thickness of approximately 10 mils.

16. The corrosion protection system of claim 1 wherein the critical parts are coated before the assembly of the critical parts with the noncritical parts and before submerging of the offshore structure.

17. The corrosion protection system of claim 1 wherein the layer of material is a thin noble coating.

18. The corrosion protection system of claim 20 wherein the noble coating is gold.

19. The corrosion protection system of claim 17, wherein the noble coating has a thickness in the range of $1\times10^{-8}$ mm to 1 mm.

20. The corrosion protection system of claim 17 wherein the noble coating has a thickness of approximately $1\times10^{-6}$ mm.

21. The corrosion protection system of claim 17 additionally including a protective shroud covering and protecting the noble coating.

22. The corrosion protection system of claim 21 wherein the shroud is formed of a heavy coal tar reinforced glass wrap material.

23. The corrosion protection system of claim 1 additionally including doubler plates located in the area intermediate to the critical parts and the noncritical parts.

24. The corrosion protection system of claim 1 additionally including dielectric shields located in the area intermediate to the critical parts and the noncritical parts.

25. The corrosion protection system of claim 1 additionally including sacrificial anodes located on the noncritical parts to supply additional corrosion protection.

26. The corrosion protection system of claim 1 additionally including means for providing for the selective removal of at least a portion of the layer of material from particular areas of the critical parts to allow for accelerated corrosion at a desired time to produce destruction of the offshore structure.

27. The corrosion protection system of claim 26 additionally including a coating of conductive material on the particular areas of the critical parts and with the coating including a slit to provide for a high cathode to anode ratio between the area of the conductive material relative to the area of the slit to produce a rapid and deep corrosive groove at the particular areas of the critical parts.

28. The corrosion protection system of claim 27 wherein the coating of conductive material is a copper foil.

29. The corrosion protection system of claim 27 additionally including chemical material positioned around the slit to enhance the accelerated corrosion.

30. The corrosion protection system of claim 29 wherein the chemical material is in a putty form contained in a semipermeable bag to leach out at a controlled rate.

31. The corrosion protection system of claim 29 wherein the chemical is ammonium bicarbonate.

32. A method of providing corrosion protection for critical parts of an offshore structure wherein the structure is composed of an assembly of critical parts representing a small portion of the structure and noncritical parts representing a large portion of the structure, including the following steps:

coating the critical parts with a layer of material having a composition to form a noble or passifying protective treatment so that the critical parts are made electrochemically noble or passive relative to the uncoated noncritical parts when the offshore structure is submerged, and submerging the offshore structure to have the noncritical parts become electrochemically active relative to the coated critical parts to provide for cathodic protection current supplied to the coated critical parts by the uncoated active parts to produce corrosion protection to the coated critical parts.

33. The method of claim 32 wherein the coated critical parts include the node members of an offshore platform.

34. The method of claim 32 wherein the coated critical parts include tension members of an offshore platform.

35. The method of claim 32 wherein the coated critical parts include portions of a well casing template of an offshore platform.

36. The method of claim 32 wherein the layer of material is a passive coating.

37. The method of claim 36 wherein the passive coating is an elastomeric mortar.

38. The method of claim 37 wherein the elastomeric mortar includes Portland cement.

39. The method of claim 38 wherein the Portland cement is supersaturated in the elastomeric mortar.

40. The method of claim 37 wherein the passive coating has a thickness in the range of 0.01 to 12 inches.

41. The method of claim 37 wherein the passive coating has a thickness of approximately 0.25 inches.

42. The method of claim 37 additionally including the step of coating with a thin primer coat of mortar before the coating of the layer of elastomeric mortar.

43. The method of claim 42 wherein the primer coat is an organic polymer containing Portland cement.

44. The method of claim 43 wherein the Portland cement is supersaturated in the organic polymer.

45. The method of claim 42 wherein the primer coat has a thickness in the range of 0.5 to 250 mils.

46. The method of claim 42 wherein the primer coat has a thickness of approximately 10 mils.

47. The method of claim 32 wherein the critical parts are coated before the assembly of the critical parts with the noncritical parts and before submerging of the offshore structure.

48. The method of claim 32 wherein the layer of material is a thin noble coating.

49. The method of claim 48 wherein the noble coating is gold.

50. The method of claim 48 wherein the noble coating has a thickness in the range of $1\times10^{-8}$ mm to 1 mm.

51. The method of claim 48 wherein the noble coating has a thickness of approximately $1\times10^{-6}$ mm.

52. The method of claim 48 additionally including the step of covering and protecting the noble coating with a protective shroud.

53. The method of claim 52 wherein the shroud is formed of a heavy coal tar reinforced glass wrap material.

54. The method of claim 32 additionally including the step of providing doubler plates located in the area intermediate to the critical parts and the noncritical parts.

55. The method of claim 32 additionally including the step of providing dielectric shields located in the area intermediate to the critical parts and the noncritical parts.

56. The method of claim 32 additionally including the step of providing sacrifical anodes located on the noncritical parts to supply additional corrosion protection.

57. The method of claim 32 additionally including the step of selectively removing at least a portion of the layer of material from particular areas of the critical parts to allow for accelerated corrosion at a desired time to produce destruction of the offshore structure.

58. The method of claim 57 additionally including the step of coating conductive material on the particular areas of the critical parts and with the coating including a slit to provide for a high cathode to anode ratio between the area of the coating relative to the area of the slit to produce a rapid and deep corrosive groove at the particular areas of the critical parts.

59. The method of claim 58 wherein the coating of conductive material is a copper foil.

60. The method of claim 58 additionally including the step of providing chemical material positioned around the slit to enhance the accelerated corrosion.

61. The method of claim 60 wherein the chemical material is in a putty form contained in a semipermeable bag to leach out at a controlled rate.

62. The method of claim 61 wherein the chemical is ammonium bicarbonate.

63. An accelerated corrosion system for destroying critical parts of an offshore structure wherein the structure is composed of an assembly of critical parts representing a small portion of the structure and noncritical parts representing a large portion of the structure, including means for coating particular areas of the critical parts with a layer of conductive material and with the layer including a slit to provide for a high cathode to anode ratio between the area of the layer relative to the area of the slit to produce a rapid and deep corrosive groove at the particular areas of the critical parts, means for providing a layer of protective material covering and protecting the conductive layer, and means for providing for the selective removal of at least a portion of the layer of protective material to expose the conductive material and slit at the particular areas of the critical parts to allow for accelerated corrosion at a desired time to produce destruction of the offshore structure.

64. The accelerated corrosive system of claim 63 wherein the coating of conductive material is a copper foil.

65. The accelerated corrosive system of claim 63 additionally including chemical material positioned around the slit to enhance the accelerated corrosion.

66. The accelerated corrosive system of claim 63 wherein the chemical material is in a putty form contained in a semipermeable bag to leach out at a controlled rate.

67. The accelerated corrosive system of claim 65 wherein the chemical is ammonium bicarbonate.

68. The accelerated corrosion system of claim 63 wherein the layer of protective material forms a protective treatment for the critical parts to make the critical parts electrochemically noble or passive relative to the noncritical parts to provide for cathodic protection current supplied to the critical parts by the noncritical parts when the offshore structure is submerged.

69. An accelerated corrosion system for destroying critical parts of an offshore structure wherein the structure is composed of an assembly of critical parts representing a small portion of the structure and noncritical parts representing a large portion of the structure, including means for coating particular areas of the critical parts with a layer of conductive material and with the layer including a slit to provide for a high cathode to anode ratio between the area of the layer relative to the area of the slit to produce a rapid and deep corrosive groove at the particular areas of the critical parts to provide for accelerated corrosion at a desired time to produce destruction of the offshore structure.

70. The accelerated corrosive system of claim 69 wherein the coating of conductive material is a copper foil.

71. The accelerated corrosive system of claim 69 additionally including chemical material positioned around the slit to enhance the accelerated corrosion.

72. The accelerated corrosive system of claim 71 wherein the chemical material is in a putty form contained in a semipermeable bag to leach out at a controlled rate.

73. The accelerated corrosive system of claim 71 wherein the chemical is ammonium bicarbonate.

74. A corrosion protection system for protecting critical parts of an offshore structure wherein the structure is composed of an assembly of critical parts representing a small portion of the structure and noncritical parts representing a large portion of the structure, including means for coating the critical parts with a layer of material to form a protective treatment so that the critical parts are made electrochemically noble or passive relative to the uncoated noncritical parts when the offshore structure is submerged, the noncritical parts being electrochemically active relative to the coated critical parts to provide for cathodic protection current supplied to the coated critical parts by the uncoated active parts to produce corrosion protection to the coated critical parts, the critical parts being coated before the assembly of the critical parts with the noncritical parts and before submerging of the offshore structure, and the assembly of critical and noncritical parts including intermediate joint areas and additionally including means for coating the joint areas with an additional layer of material to provide the protective treatment.

75. The corrosion protection system of claim 74 wherein the additional layer of material is an elastomeric mortar.

76. The corrosion protection system of claim 74 including further means for coating the critical parts after submerging of the assembly with a further layer of material to provide the protection treatment after submerging to repair any damage.

77. A corrosion protection system for protecting critical parts of an offshore structure wherein the structure is composed of an assembly of critical parts representing a small portion of the structure and noncritical parts representing a large portion of the structure, including means for coating the critical parts with a layer of material to form a protective treatment so that the critical parts are made electrochemically noble or passive relative to the uncoated noncritical parts when the offshore structure is submerged, the noncritical parts being electrochemically active relative to the coated critical parts to provide for cathodic protection current supplied to the coated critical parts by the uncoated active parts to produce corrosion protection to the coated critical parts.

means for providing for the selective removal of at least a portion of the layer of material from particular areas of the critical parts to allow for accelerated corrosion at a desired time to produce destruction of the offshore structure, a coating of conductive material on the particular areas of the critical parts and with the coating including a slit to provide for a high cathode to anode ratio between the area of the conductive material relative to the area of the slit to produce a rapid and deep corrosive groove at the particular areas of the critical parts, wherein the coating of conductive material is a copper foil, and the means for providing for the selective removal includes braided material located intermediate to the coating of conductive material and the layer of material and with removal of the braided material selectively removing at least the portion of the layer of material to expose the coating of conductive material and the slit.

78. The corrosion protection system of claim 77 including means for interconnecting the braided material at a plurality of critical parts to activate the accelerated corrosion sequentially at the plurality of critical parts.

79. A method of providing corrosion protection for critical parts of an offshore structure wherein the structure is composed of an assembly of critical parts representing a small portion of the structure and noncritical parts representing a large portion of the structure, including the following steps:

coating the critical parts with a layer of material to form a protective treatment so that the critical parts are made electrochemically noble or passive relative to the uncoated noncritical parts when the offshore structure is submerged, submerging the offshore structure to have the noncritical parts become electrochemically active relative to the coated critical parts to provide for cathodic protection current supplied to the coated critical parts by the uncoated active parts to produce corrosion protection to the coated critical parts, the critical parts being coated before the assembly of the critical parts with the noncritical parts and before submerging of the offshore structure, and wherein the assembly of critical and noncritical parts includes intermediate joint areas and additionally including the step of coating the joint areas with an additional layer of material to provide the protective treatment.

80. The method of claim 79 wherein the additional layer of material is an elastomeric mortar.

81. The method of claim 79 including a further step of coating the critical parts after submerging of the assembly with a further layer of material to provide the protective treatment after submerging to repair any damage.

82. A method of providing corrosion protection for critical parts of an offshore structure wherein the structure is composed of an assembly of critical parts representing a small portion of the structure and noncritical parts representing a large portion of the structure, including the following steps:

coating the critical parts with a layer of material to form a protective treatment so that the critical parts are made electrochemically noble or passive relative to the uncoated noncritical parts when the offshore structure is submerged, submerging the offshore structure to have the noncritical parts become electrochemically active relative to the coated critical parts to provide for cathodic protection current supplied to the coated critical parts by the uncoated active parts to produce corrosion protection to the coated critical parts, selectively removing at least a portion of the layer of material from particular areas of the critical parts to allow for accelerated corrosion at a desired time to produce destruction of the offshore structure, coating conductive material on the particular areas of the critical parts and with the coating including a slit to provide for a high cathode to anode ratio between the area of the coating relative to the area of the slit to produce a rapid and deep corrosive groove at the particular areas of the critical parts, wherein the coating of conductive material is a copper foil, and the step of selectively removing includes providing a braided material located intermediate to the coatings of conductive material and the layer of material and with removal of the braided material selectively removing at least the portion of the layer of material to expose the coating of conductive material and the slit.

83. The method of claim 82 including the step of interconnecting the braided material at a plurality of critical parts to activate the accelerated corrosion sequentially at the plurality of critical parts.

84. An accelerated corrosion system for destroying critical parts of an offshore structure wherein the structure is composed of an assembly of critical parts representing a small portion of the structure and noncritical parts representing a large portion of the structure, including means for coating particular areas of the critical parts with a layer of conductive material and with the layer including a slit to provide for a high cathode to anode ratio between the area of the layer relative to the area of the slit to produce a rapid and deep corrosive groove at the particular areas of the critical parts, means for providing a layer of protective material covering and protecting the conductive layer, means for providing for the selective removal of at least a portion of the layer of protective material to expose the conductive material and slit at the particular areas of the critical parts to allow for accelerated corrosion at a desired time to produce destruction of the offshore structure, and the means for providing for the selective removal includes braided material located intermediate to the coating of conductive material and the layer of protective material and with removal of the braided material selectively removing at least the portion of the layer of protective material to expose the coating of conductive material and the slit.

85. The accelerated corrosive system of claim 84 including means for interconnecting the braided material at a plurality of critical parts to activate the accelerated corrosion sequentially at the plurality of critical parts.

* * * * *